US007100886B2

(12) United States Patent
Hammer et al.

(10) Patent No.: US 7,100,886 B2
(45) Date of Patent: Sep. 5, 2006

(54) APPARATUS AND METHODS FOR MAKING A MASONRY BLOCK WITH A ROUGHENED SURFACE

(75) Inventors: James Hammer, Fircrest, WA (US); Llewellyn Lee Johnston, Vancouver, WA (US)

(73) Assignee: Westblock Systems, Inc., Salem, OR (US)

( * ) Notice: Subject to any disclaimer, the term of this patent is extended or adjusted under 35 U.S.C. 154(b) by 511 days.

(21) Appl. No.: 10/091,039

(22) Filed: Mar. 4, 2002

(65) Prior Publication Data

US 2003/0164574 A1 Sep. 4, 2003

(51) Int. Cl.
*B28B 11/08* (2006.01)

(52) U.S. Cl. ..... 249/104; 249/162; 425/385; 425/470

(58) Field of Classification Search ..... 249/52, 249/63, 140, 142, 160, 161; 425/385, 436 R, 425/441, 470

See application file for complete search history.

(56) References Cited

U.S. PATENT DOCUMENTS

| | | | | |
|---|---|---|---|---|
| 1,219,127 | A | 3/1917 | Marshall | |
| 3,940,229 | A | 2/1976 | Hutton | |
| 3,981,953 | A | 9/1976 | Haines | |
| 4,093,174 | A * | 6/1978 | Mullins | 249/120 |
| 5,078,940 | A | 1/1992 | Sayles | |
| 5,217,630 | A | 6/1993 | Sayles | |
| 5,568,994 | A | 10/1996 | Dawson | |
| 5,722,386 | A * | 3/1998 | Fladgard et al. | 125/23.01 |
| 5,771,631 | A | 6/1998 | Dawson | |
| 5,879,603 | A | 3/1999 | Sievert | |
| 6,113,379 | A | 9/2000 | LaCroix et al. | |
| 6,138,983 | A | 10/2000 | Sievert | |
| 6,159,401 | A | 12/2000 | Hoesch | |
| 6,209,848 | B1 | 4/2001 | Bolles et al. | |
| 6,224,815 | B1 | 5/2001 | LaCroix et al. | |
| 6,464,199 | B1 * | 10/2002 | Johnson | 249/117 |

FOREIGN PATENT DOCUMENTS

| | | | |
|---|---|---|---|
| JP | 07-052133 | * | 2/1995 |
| JP | 2001-191314 | * | 7/2001 |

OTHER PUBLICATIONS

Photographs of a "softsplit mold," pp. 1-3 (in use prior to 2002).

* cited by examiner

*Primary Examiner*—Duane Smith
*Assistant Examiner*—Thu Khanh T. Nguyen
(74) *Attorney, Agent, or Firm*—Klarquist Sparkman, LLP

(57) ABSTRACT

Apparatus and methods are disclosed for making masonry blocks with one or more surfaces having a roughened texture resembling that of a split block or natural stone. In one embodiment, a mold comprises a plurality of walls defining at least one mold cavity adapted to receive block-forming material. The mold defines an opening through which a formed, uncured block may be removed from the mold. At least one wall of the mold has a plurality of projections extending into the mold cavity so as to contact an adjacent surface of the uncured block in the mold cavity. The projections are positioned such that when the uncured block is removed from the mold, the projections texture the adjacent surface of the uncured block.

40 Claims, 2 Drawing Sheets

FIG. 3
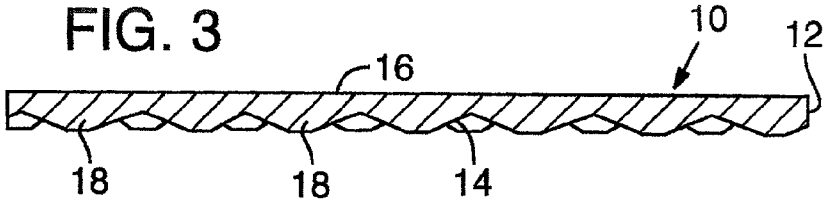
FIG. 2
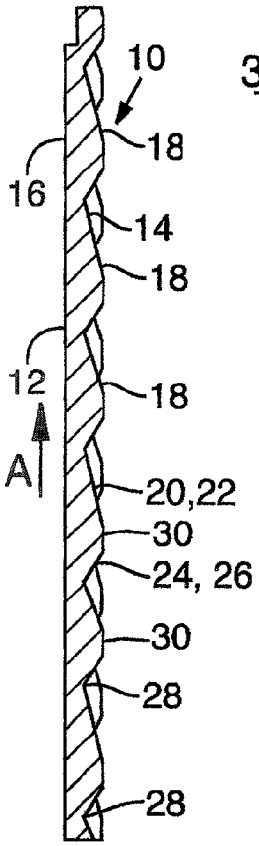
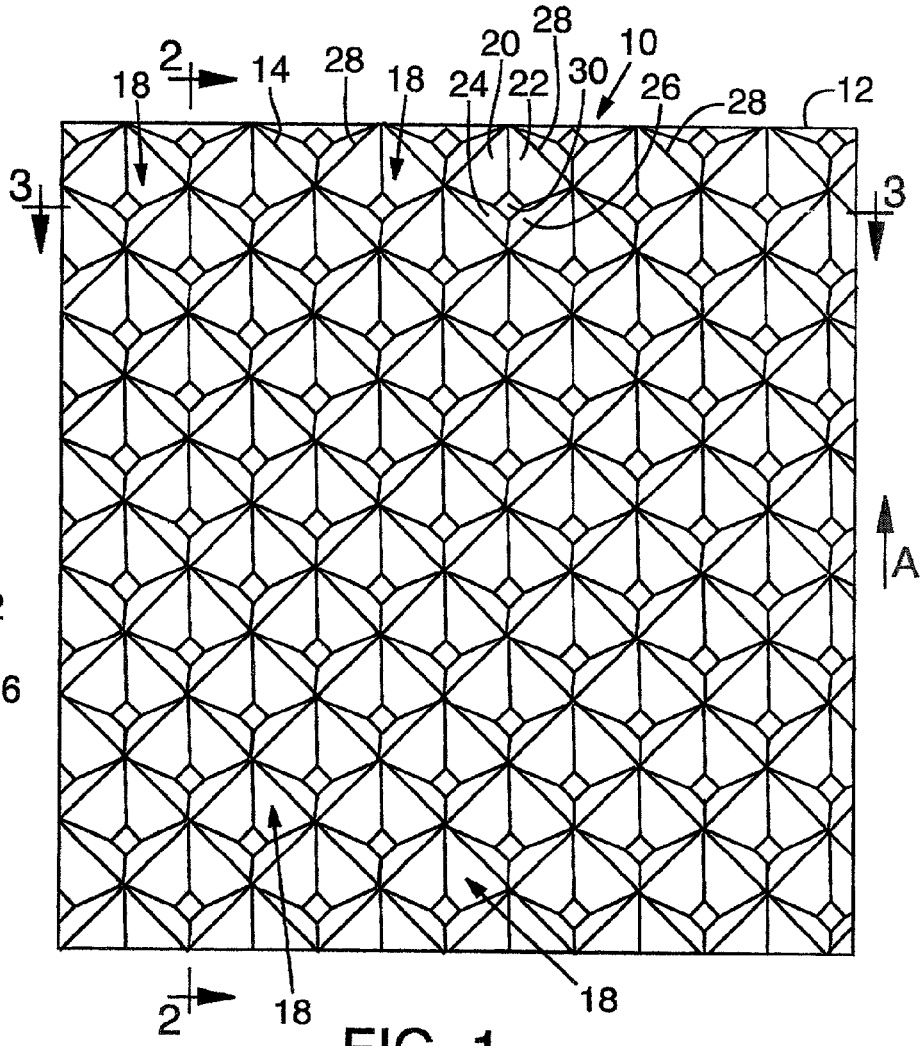
FIG. 1

APPARATUS AND METHODS FOR MAKING A MASONRY BLOCK WITH A ROUGHENED SURFACE

FIELD

This invention relates to an apparatus and method for making a masonry block, such as a retaining block, in which one or more surfaces have a roughened texture resembling that of a split block or natural stone.

BACKGROUND

Masonry products, such as blocks or bricks for constructing walls, have been made for many years by molding processes. A typical molding process involves the use of what is commonly known as a static block-making machine. Pallets made from metal or wood are fed by a conveyor into the block-making machine, which generally comprises a mold, a stripping device, a vibration mechanism, and a device for filling the mold with a cementitious mix. After the pallet has been located, the mold is lowered onto the pallet to form a mold cavity defined by the upper surface of the pallet and the inside surfaces of the side walls of the mold. A cementitious mix is then introduced into the mold cavity through the open top of the mold while simultaneously vibrating the mold and/or pallet. A compression or compacting head is lowered onto the cementitious material in the mold to facilitate densification of the cementitious material. The molded cementitious material is then stripped from the mold by raising the mold while the compacting head remains stationary relative to the mold, thereby pushing the molded block through the open bottom of the mold.

It is common to split off a portion of the cured block, such as with a splitting machine or a hammer and chisel, so as to create a decorative face on a surface of the block that resembles the surface texture of natural stone. The face created by the splitting process is often referred to in the industry as "split face" or "rock face." The splitting of cured blocks, however, involves additional equipment and manufacturing steps and results in material wastage. In order to avoid the shortcomings of conventional splitting processes, there have been efforts to achieve the same "split face" texture without additional splitting steps.

There are a number of patents, which disclose methods and apparatuses for producing a roughened surface on an uncured block during the molding process. For example, U.S. Pat. No. 3,981,953 to Haines is understood to disclose a method of forming a roughened block face in which cementitious material is placed in a mold cavity, with a grid-like series of elements being disposed in the cavity and suspended from a top plate. After the block material is compacted into the cavity, the side walls and top plate are drawn off the molded but uncured block. Upward movement of the top plate lifts the grid-like series of elements, and the block material between the elements and the lower plate is broken off from the lower block material in the mold, forming a roughened texture on the top face of the block. A drawback to this arrangement is that the pattern of the elements is cast in the top face of the block.

U.S. Pat. No. 3,940,229 to Hutton is understood to disclose a mold in which a small lip is formed on the inner, lower edge of a vertical wall of the mold. As the densified, composite material is stripped from the mold, the lip moves vertically up an adjacent side wall of the block, and tears some of the composite material away from the surface of the block. The lip temporarily retains this composite material in place against a portion of the mold wall as the mold is stripped. The retained material is thus dragged, or rolled, up the surface of the adjacent side wall of the block as the mold is stripped, creating a roughened texture on the side wall of the block.

The process of the '229 patent tends to produce a textured face having horizontal striations so as to provide what may be referred to as a "shingled" appearance. In addition, the textured face is slightly tapered or sloped, as a result of the lip retaining fill material as the mold is stripped from the block.

Another example of an alternative to splitting is shown in U.S. Pat. Nos. 5,078,940 and 5,217,630 to Sayles. These patents are understood to disclose a mold having a lower lip on a vertical wall of the mold, similar to that shown in the '229 patent. In addition, the mold employs a plurality of projections on the vertical wall above the lip, and a vertically oriented reinforcing mesh above the lip and spaced from the projections. When the mold is initially filled, the cementitious material fills in between the mesh and the wall, and around the projections. The combination of the lip, mesh and projections holds a large mass of compacted material against the mold as the mold is moved vertically upward to strip the uncured block from the mold. These patents appear to show the retained mass of material shearing from the rest of the material, and thus creating a roughened face on the molded block.

In the process of the '940 and '630 patents, the use of the projections holds a much larger mass of material against the mold side wall than is the case in the '229 process, and does this in a fashion so as to retain that material in the mold from cycle to cycle. Consequently, frequent stoppages in production may be required to clean the mold of material accumulated between the projections. Further, cleaning of the mold may be complicated by the presence of the screen.

Yet another apparatus for producing a block with a roughened surface is shown in U.S. Pat. Nos. 5,879,603 and 6,138,983 to Sievert. The '603 and '983 patents are understood to disclose a mold having generally parallel upper and lower lips on a vertical wall of the mold. As the mold is moved vertically to strip the uncured block from the mold, fill material is retained in the space between the upper and lower lips. Like the process of the '940 and the '630 patents, the retained material is sheared from the uncured block, thereby creating a roughened surface.

U.S. Pat. No. 6,209,848 to Bolles discloses an apparatus that is similar to the apparatus of the '603 and '983 patents. The '848 patent discloses a mold in which a lip is formed along the bottom edge of at least one wall of the mold, wherein a series of grooves are formed along the length of the lip.

Finally, U.S. Pat. Nos. 6,113,379 and 6,224,815 to LaCroix are understood to disclose a mold having two mold cavities separated by a metal grate. The grate has openings to permit fill material to flow through the openings and form a single molded article in the mold. When the molded article is discharged from the mold, the article is separated into two masonry units by the grate, with each masonry unit having a roughened surface where the units were previously joined.

Despite the foregoing processes, there exists a continuing need for new and improved methods and apparatus for producing a masonry block that does not involve splitting but which creates a textured surface that resembles the "split face" look that can be achieved with a conventional splitting process.

SUMMARY

According to one aspect of the invention, an apparatus for making a masonry block with at least one roughened surface is provided. In one representative embodiment, a mold comprises a plurality of walls defining at least one mold cavity adapted to receive block-forming material. The mold defines an opening through which a formed, uncured block may be removed from the mold. At least one wall of the mold has a plurality of projections extending into the mold cavity so as to contact an adjacent surface of the uncured block in the mold cavity. The projections are positioned such that when the uncured block is removed from the mold, the projections texture the adjacent surface of the uncured block.

Desirably, the projections taper as they extend away from the wall of the mold. In a disclosed embodiment, the projections are generally frusto-pyramidal in shape and desirably are oriented on the wall with two side surfaces facing in a generally upward direction and two other side surfaces facing in a generally downward direction. Desirably, although not necessarily, the two generally upwardly facing side surfaces of each projection have a slope that is less than the slope of the two generally downwardly facing side surfaces. In addition, at least some of the projections are located between the top and bottom of the mold. In one example, the projections may be positioned in plural rows of projections along the wall of the mold, with the projections being in contacting relationship with other at their bases so as to minimize spacing between adjacent projections.

In addition, the mold may have a separating wall for separating the mold into first and second mold cavities, each of which is adapted to receive block-forming material for forming first and second blocks, respectively. A first major surface of the separating wall may have a plurality of projections extending into the first mold cavity for texturing a surface of the first block. A second major surface of the separating wall may have a plurality of projections extending into the second mold cavity for texturing a surface of the second block.

According to yet another representative embodiment, an apparatus for molding masonry blocks comprises a mold. A plurality of mold walls define an interior space of the mold. A separating member separates the interior space into first and second mold cavities, each being adapted to receive block-forming material for forming first and second blocks, respectively. The separating member has first and second major surfaces, with the first major surface forming an interior surface of the first mold cavity and the second major surface forming an interior surface of the second mold cavity. A plurality of projections are disposed on one of said mold walls and extend into the first mold cavity. A plurality of projections are also disposed on another of the mold walls and extend into the second mold cavity. In addition, the first and second major surfaces of the separating member have a plurality of projections extending into the first and second mold cavities, respectively. The projections are positioned such that when the first and second blocks are removed from the mold, the projections produce a roughened texture on at least two surfaces of the first and second blocks.

According to another aspect of the invention, a wall for use in a mold for making a masonry block with a roughened surface is provided. The wall, in one configuration, comprises a body having first and second major surfaces. At least one of the first and second major surfaces has a plurality of block-texturing members extending outwardly from the body. Desirably, the block-texturing members taper as they extending away from the body. In another configuration, both the first and second major surfaces have a plurality of block-texturing members. In either case, the body and the block-texturing members may be of a unitary construction, or alternatively, the block-texturing members may be configured to be removable from the body.

The block-texturing members in an illustrated embodiment are generally frusto-pyramidal in shape. Desirably, although not necessarily, the block-texturing members may have a side surface that has a slope greater than that of another side surface. In addition, the block-texturing members may be positioned side-by-side in contacting relationship with each other along one or both of the first and second major surfaces.

According to another aspect of the invention, a method for making a masonry block having at least one roughened surface is provided. In one specific approach, block-forming material is introduced into a mold cavity having plural inwardly extending projections located between the top and bottom of the mold cavity. An uncured block is formed in the mold cavity, after which the mold cavity is moved relative to the uncured block. The relative movement of the mold cavity causes the projections to produce a roughened texture on a surface of the uncured block. Typically, moving the mold cavity for producing the roughened texture on the block comprises moving the mold cavity (e.g., raising the mold cavity) until the uncured block is removed, or stripped, from the mold cavity. The projections desirably are configured to avoid retaining block-forming material in the spaces between adjacent projections as the uncured block is removed from the mold.

These and other features of the invention will be more fully appreciated when the following detailed description of the invention is read in conjunction with the accompanying drawings.

BRIEF DESCRIPTION OF THE DRAWINGS

FIG. 1 is a front elevational view of a mold wall according one embodiment for use in a mold for forming a masonry block, showing a plurality of frusto-pyramidal shaped projections extending outwardly from one major surface of the wall.

FIG. 2 is a cross-sectional view of the mold wall of FIG. 1 taken along line 2—2 of FIG. 1.

FIG. 3 is a cross-sectional view of the mold wall of FIG. 1 taken along line 3—3 of FIG. 1.

DETAILED DESCRIPTION

According to one aspect, the invention provides an apparatus and method for making masonry units or blocks having one or more roughened surfaces without using conventional splitting techniques. The invention can be adapted for use with different types of molds to produce various types of blocks, such as decorative architectural blocks, paving stones, landscaping blocks, retaining wall blocks and the like.

Figure 4:
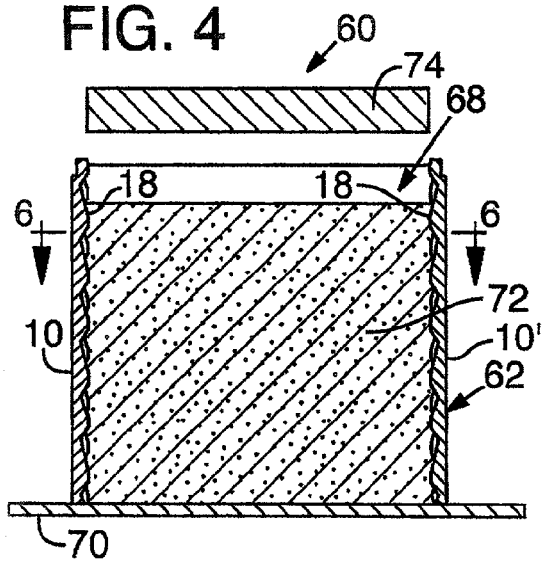
FIG. 4 is a cross-sectional view of an apparatus, including a mold filled with cementitious material, according to one embodiment for molding a masonry block, in which the forward and rear walls of a mold have the same general configuration as the mold wall shown in FIG. 1.
Figure 5:
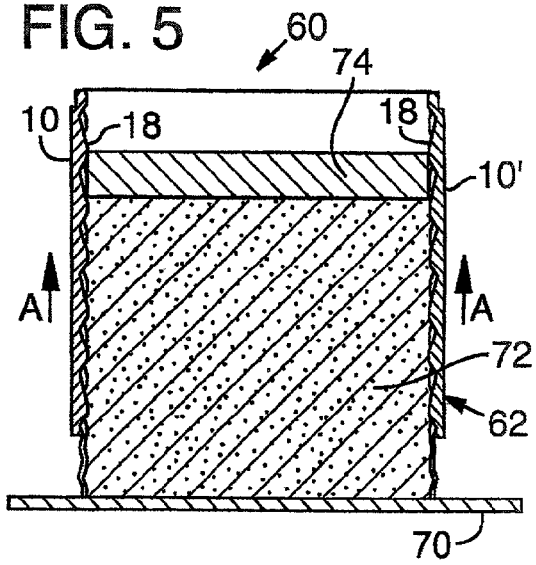
FIG. 5 is a cross-sectional view of the apparatus of FIG. 4 showing a formed, uncured block being removed from the mold.
Figure 6:
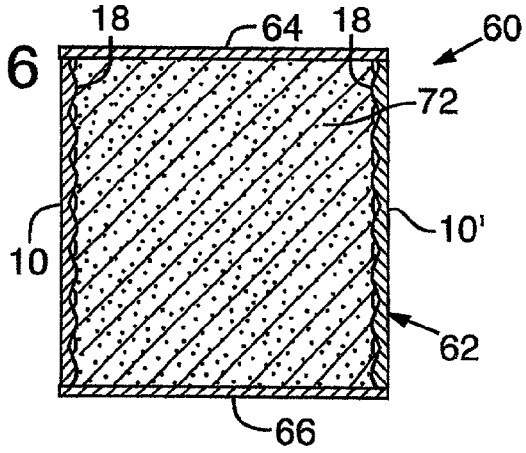
FIG. 6 is a horizontal cross-sectional view of the mold of FIG. 4 taken along line 6—6 of FIG. 4.

Referring first to FIGS. 4–6, there is shown a schematic illustration of a block-forming apparatus 60, according to one embodiment, for forming a masonry unit or block having at least one roughened surface. The apparatus 60 in the illustrated configuration comprises a generally rectangular-shaped mold 62 supported on a suitable support surface, such as a pallet 70. As shown, the mold 62 comprises vertically upright opposed forward and rear walls 10, 10', respectively, and opposed side walls 64, 66, extending between respective ends of the forward and rear walls 10, 10'

(FIG. 6). The walls 10, 10', 64 and 66 collectively define a mold cavity 68 adapted to receive fill material (also referred to herein as block-forming material) for forming a block 72. The walls 10, 10', 64 and 66 are desirably generally impervious to block-forming material so that block-forming material is retained in the mold cavity 68 by the walls. The mold 62 has an open top through which fill material may be introduced into the mold cavity 68 and an open bottom through which the formed, uncured block 72 may be removed, or stripped, from the mold cavity 68.

A substantially horizontal pusher plate 74 may be provided to facilitate compression of the fill material during the block forming process and removal of the formed, uncured block 72 from the mold cavity 68. The pusher plate 74, which is shaped so as to be able to fit slidably within the mold cavity 68, is operable for movement between a raised position above the mold 62 (FIG. 4) and a lowered position within the mold cavity 68 for compressing the fill material and for removing the formed, uncured block from the mold cavity 68 (FIG. 5). The pusher plate 74 may be coupled to any suitable mechanism for moving the pusher plate 74 between the raised and lowered positions and for pressing the pusher plate 74 against the top surface of the block 72. For example, the pusher plate 74 may be coupled to a hydraulic ram, as generally known in the art.

The shape of the mold cavity 68 defines the plan shape and size of the block 72 (i.e., the shape and size of the block when viewed from above or below), with each wall 10, 10', 64 and 66 forming an adjacent vertical surface of the block 72. The bottom and top surface of the block 72 are formed by the upper surface of the pallet 70 and the lower surface of the pusher plate 74, respectively. The walls 10, 10', which, in the illustrated embodiment, are identical in construction, have interior surfaces configured to texture adjacent surfaces of the block 72 as it is removed from the mold cavity 68, as explained in greater detail below. The mold cavity 68 in the configuration shown in FIGS. 4–6 has a generally rectangular plan shape to provide a block having the same shape. However, the shape of the mold cavity 68 can be varied to provide blocks having other geometrical plan shapes. For example, one or more of the walls defining the mold cavity 68 can be configured to intersect an adjacent wall at an angle that is greater than or less than 90°. In addition, one or more of the walls of the mold cavity 68 may be curved or rounded. Alternatively, a wall may comprise plural segments interconnected to each other at angles. Moreover, the mold cavity 68 may have greater than or less than four vertical walls.

Although the mold 62 of FIGS. 4–6 is shown as having two walls for texturing opposed surfaces of the block 72 (walls 10, 10'), in other embodiments, only one such wall may be used, or alternatively, two adjacent such walls may be used, or more than two walls for texturing the surfaces of a block may be used.

FIGS. 1–3 illustrate in greater detail the wall 10 of the mold 62 shown in FIGS. 4–6. As mentioned, the wall 10' is identical in construction to wall 10. Thus, the following description, which proceeds in reference to the wall 10, is also applicable to the wall 10'. The wall 10 in the illustrated configuration comprises a body 12 having first major surface 14, which serves as an interior surface of the mold cavity 68, and second major surface 16. A plurality of abutting block-texturing members, or projections, 18 extend outwardly from the first surface 14. As shown in FIGS. 4 and 5, the projections 18 on the walls 10, 10' project into the mold cavity 68 and contact an adjacent surface of the block 72. As the mold 62 is moved vertically with respect to the block 72 for removing the block 72 from the mold cavity 68, as indicated by arrow A in FIG. 5, the projections 18 produce a "scraping," or "tearing," action on the respective adjacent surfaces of the block 72, thereby creating an irregularly roughened surface for those sides of the block 72.

As shown in FIGS. 1–3, the projections 18 desirably taper as they extend outwardly from the first surface 14. In the illustrated embodiment, for example, each projection 18 is generally "frusto-pyramidal" in shape, that is, each projection 18 has a square-shaped base 28 at the first surface 14, a flattened, square-shaped end surface or crest 30 spaced from the base 28, and four flat side surfaces 20, 22, 24 and 26 that converge as they extend from the base 28 to the end surface 30. However, it is contemplated that other tapered or non-tapered shapes may be used for the projections 18. For example, the projections 18 may be pyramidal, conical, frusto-conical, rectangular, square, cylindrical, or any of other various shapes.

Desirably, the projections 18 are distributed uniformly throughout the surface area of the first major surface 14. As best shown in FIG. 1, the projections 18 desirably are arranged side-by-side in diagonal rows extending across the first surface 14 without spacing between projections or between adjacent rows of projections. Although less desirable, in other embodiments, the rows of projections 18 may extend horizontally across the first surface so as to form a "checkerboard" pattern of projections. In addition, in other embodiments, the projections 18 may be spaced apart in the direction of the rows of projections. In still other embodiments, the rows of projections may be spaced from each other.

As shown in FIG. 1 and except for those projections bordering the edges of the wall 10, the base 28 of each projection 18 adjoins the base 28 of an adjacent projection to minimize spacing between the crests 30 of adjacent projections. The side surfaces 20, 22 of each projection 18 face in a generally upward direction and the side surfaces 24, 26 of each projection 18 face in a generally downward direction. Thus, it can be seen that the side surfaces 20, 22, along with the end surface or crest 30, of each projection 18 produce the scraping action against the adjacent surface of the block 72 as the wall 10 is moved vertically with respect to the block 72 in the direction of arrow A.

In the illustrated embodiment, the side surfaces 20, 22 of the projections 18 have slopes that are less than the slopes of the side surfaces 24, 26. It is believed that this minimizes the likelihood of fill material being retained in the spaces between adjacent projections as the block 72 is being removed from the mold cavity 68.

In the embodiment of FIGS. 1–3, the wall 10 and the projections 18 are of a unitary, monolithic construction. The wall 10 may be formed by machining the projections 18 into one surface of apiece material used to form the mold wall. In one specific implementation, the projections 18 are machined in a ½ inch thick piece of material (e.g., steel) to a depth of about ¼ inch. The width of each projection is about 0.87 inch at their respective bases 28 and about 0.19 inch at their respective end surfaces 30.

In other embodiments, the projections may be separately formed and then coupled or otherwise mounted to the mold wall, such as by welding or with conventional releasable fasteners (e.g., bolts). If releasable fasteners are used, projections that are worn-out can be removed and replaced with new projections.

In still other embodiments, the walls 10, 10' can be used as "inserts" for an existing mold. When used in this manner, the walls 10, 10' are coupled to the interior surfaces of existing walls of a mold.

Explaining the operation of the apparatus 60, according to one specific approach, and referring initially to FIG. 4, the mold 62 and the pallet 70 can be moved into place under the pusher plate 74, such as by way of a conveyor (not shown). The mold 62 is then loaded with a flowable, composite cementitious fill material through the open top of the mold. Composite fill material generally comprises, for example, aggregate material (e.g., gravel or stone chippings), sand, mortar, cement, and water, as generally known in the art. The fill material also may comprise other ingredients, such as pigments, plasticizers, and other fill materials, depending upon the particular application.

The mold 62, or the pallet 70, or a combination of both may be vibrated for suitable period of time to assist in the loading of the mold 62 with fill material. The pusher plate 74 is then lowered into the mold cavity 68, against the top of the mass of fill material. The pusher plate 74 desirably is sized so as to provide a slight clearance with the projections 18 of the walls 10, 10' when lowered into the mold cavity 68. Additional vibration, together with the pressure exerted by the pusher plate 74 acts to densify the fill material and form the final shape of the block 72.

After the block 72 is formed, the formed, uncured block 72 is removed from the mold such as by raising the mold 62 (as indicated by arrow A in FIG. 5), while maintaining the vertical position of the pusher plate 74 and the pallet 70 so that the block 72 is pushed through the open bottom of the mold 62. Alternatively, the block 72 can be pushed through the mold 62 by moving the pusher plate 74 through the mold 62, while simultaneously lowering the pallet and maintaining the vertical position of the mold 62. In either case, the action of stripping the block 72 from the mold 62 creates a roughened texture of the walls of the block that contact the projections 18 on walls 10, 10'. Since the mold is not configured to retain fill material for the purpose of creating the roughened surfaces of the block, unlike some prior art devices, the mold 62 does not require frequent stoppages in production to clear material from the walls of the mold.

Because the projections 18 do not retain fill material as the block 72 is stripped from the mold 62, the block 72 maintains its dimensional tolerances. Thus, the roughened surfaces of the block 72 will be substantially perpendicular to the top and bottom of the block 72 and the block 72 will have a substantially constant cross-sectional profile from top to bottom.

The mold filling time, the vibration times and the amount of pressure exerted by the pusher plate 74 are determined by the particular block-forming machine being used, and the particular application. After the block is removed from the mold 62, it may be transported to a suitable curing station, where it can be cured using any suitable curing technique, such as, air curing, autoclaving, steam curing, or mist curing.

The mold 62 may be adapted for use with any conventional block-forming machine.

Figure 7:
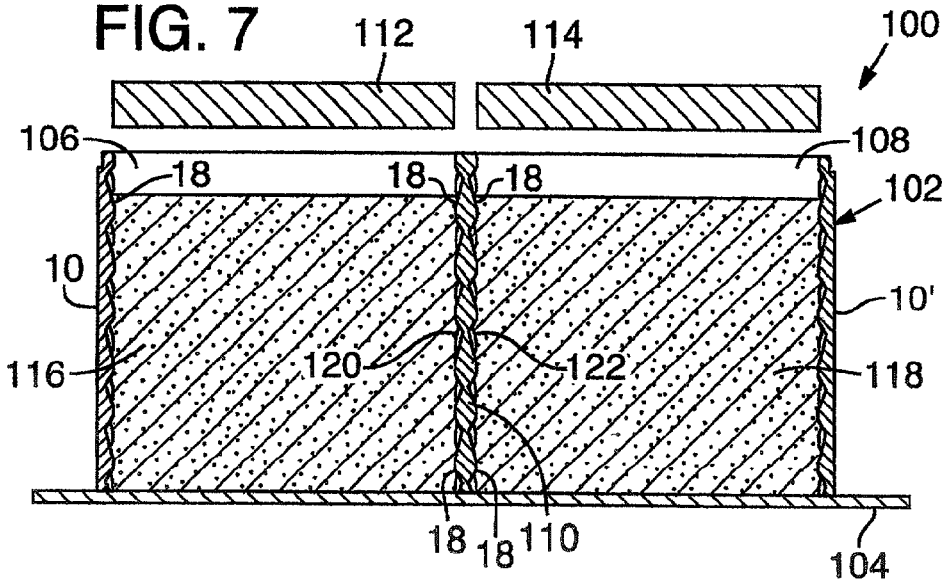
FIG. 7 is a cross-sectional view of an apparatus, including a mold filled with cementitious material, according to another embodiment for molding two masonry blocks, in which a divider plate or wall separates the mold into first and second mold cavities for forming first and second blocks, respectively.

Referring to FIG. 7, there is shown an apparatus 100 for forming two masonry blocks. In this embodiment, the apparatus 100 comprises a mold 102 supported on a suitable support surface, such as a pallet 104. The mold 102 comprises vertically upright opposed forward and rear walls 10, 10', respectively, and opposed side walls (not shown), extending between respective ends of the forward and rear walls 10, 10'. The walls of the mold 102 define a first mold cavity 106 and a second mold cavity 108, separated by a vertically upright separating wall 110 (also referred to herein as a separating member), which extends between the side walls of the mold 102. The first and second mold cavities 106, 108 are adapted to receive fill material for forming first and second blocks 116, 118, respectively. A first pusher plate 112 and a second pusher plate 114 may be provided to facilitate compression of the fill material in the first and second mold cavities 106, 108, respectively, and removal of the blocks from their respective mold cavities. Other configurations for mold 102 also may be used. For example, the first and second mold cavities 106, 108, respectively may have different shapes so that blocks of different shapes can be made.

The separating wall 110 has a first major surface 120 and a second major surface 122. As shown, the first major surface 120 helps define and serves as an interior surface of the first mold cavity 106 while the second major surface 122 helps define and serves as an interior surface of the second mold cavity 108. The wall 10 has a plurality of projections 18 extending into the first mold cavity 106 for texturing an adjacent surface of the first block 116. Similarly, the wall 10' has a plurality of projections 18 extending into the second mold cavity 108 for texturing an adjacent surface of the second block 118. In addition, both the first and second major surfaces 120, 122 of the separating wall 110 have a plurality of projections 18 extending into their associated mold cavities 106, 108, respectively, for texturing respective adjacent surfaces of blocks 116, 118. Thus, the apparatus 100 of FIG. 7 can be used to produce two blocks, each having at least two opposed roughened surfaces.

In other embodiments, either the wall 10, the wall 10', or both of the walls 10, 10' can be conventional mold walls (i.e., walls without projections 18), in which case one or both blocks would have only a single roughened surface formed by the separating wall 110. Still alternatively, more than two walls of one or both mold cavities 106, 108 can be provided with projections 18 to produce roughened surfaces on more than two surfaces of a block. Also, only one surface 120 or 122 of the separating wall 110 may be provided with projections 18, in which case one of the two blocks produced would have a different number of roughened walls than the other.

The walls 10, 10' (FIGS. 4–7), as well as wall 110 (FIG. 7), are "self-cleaning" in that they are configured to avoid retaining block-forming material as the uncured block(s) are removed from the molds. Consequently, increased production throughout can be achieved because the mold walls do not have to be cleaned between each cycle. In addition, as noted above, because the projections do not retain block-forming material, the resulting blocks maintain their dimensional tolerances.

The invention has been described with respect to particular embodiments and modes of action for illustrative purposes only. The present invention may be subject to many modifications and changes without departing from the spirit or essential characteristics thereof. We therefore claim as our invention all such modifications as come within the scope of the following claims.

We claim:

1. An apparatus for molding and forming at least one roughened surface texture on an uncured masonry block, comprising:

a mold comprising a plurality of walls defining at least one mold cavity and a first opening through which block-forming material is introduced into the mold cavity, the walls configured to retain block-forming material in the mold cavity, the mold defining a second opening through which a formed, uncured block may be removed from the mold cavity, the mold cavity having a cross-section that is constant from the first opening to the second opening; and at least one said wall including a major surface having a plurality of tapered projections extending into the mold cavity so as to contact an adjacent surface of the uncured block in the mold cavity, whereby when the uncured block is removed from the mold cavity, the projections texture the adjacent surface of the uncured block.

2. The apparatus of claim 1, wherein the projections are generally frusto-pyramidal in shape.

3. The apparatus of claim 1, wherein the projections are generally pyramidal in shape.

4. The apparatus of claim 1, wherein the projections are provided substantially throughout said major surface.

5. The apparatus of claim 1, wherein at least one of said walls comprises a separating wall separating the mold into first and second mold cavities for forming first and second blocks, respectively, the separating wall having first and second major surfaces, at least the first major surface having a plurality of projections extending into the first mold cavity for texturing a surface of the first block.

6. The apparatus of claim 5, wherein the second major surface has a plurality of projections extending into the second mold cavity for texturing a surface of the second block.

7. The apparatus of claim 1, wherein at least two of said walls include major surfaces, each having a plurality of projections extending into the mold cavity for texturing at least two surfaces of the block as the block is removed from the mold.

8. The apparatus of claim 1, wherein the major surface defines top and bottom limits of the mold cavity and wherein at least some of the projections are provided on the major surface intermediate said top and bottom limits of the mold.

9. The apparatus of claim 1, wherein said at least one wall is generally vertical and wherein each projection has two generally upwardly facing side surfaces and two generally downwardly facing side surfaces.

10. The apparatus of claim 9, wherein the two generally upwardly facing side surfaces of each projection have slopes as measured from the vertical that are less than the slopes of the two generally downwardly facing side surfaces.

11. An apparatus for molding and forming at least one roughened surface texture on an uncured masonry block, comprising:

a mold including an interior surface defining at least one mold cavity having opposite end limits and an end opening, the mold cavity being adapted to receive block-forming material to form an uncured block, and allow removal of such block from the mold cavity through the end opening, the interior surface being impervious to block-forming material; and the interior surface including rows of projections between the opposite end limits for contacting the uncured block in the mold, the projections being positioned side-by-side in each row, each projection having a respective base that adjoins a base of an adjacent projection in the same row, the rows of projections extending diagonally across the interior surface of the mold so as to define diagonally extending grooves between adjacent rows of projections, such that when the uncured block is removed from the mold cavity, the projections create a roughened texture on the surface of the uncured block.

12. The apparatus of claim 11, wherein the mold comprises a plurality of walls defining the mold cavity.

13. The apparatus of claim 12, wherein the walls define multiple mold cavities.

14. The apparatus of claim 12 further comprising a mold insert coupled to a wall of the mold, and wherein the plurality of projections are provided on the mold insert and extend into the mold cavity.

15. The apparatus of claim 12, wherein the plurality of projections are provided on one of said walls.

16. The apparatus of claim 12, wherein the walls include a separating member dividing the mold cavity into multiple mold cavities, and wherein the plurality of projections are provided on the separating member and extend into at least one of the multiple mold cavities.

17. The apparatus of claim 11, wherein the projections are tapered.

18. The apparatus of claim 11, wherein the projections are generally frusto-pyramidal or pyramidal in shape.

19. The apparatus of claim 11, wherein the projections are uniformly distributed on the interior surface.

20. An apparatus for molding and forming at least one roughened surface texture on uncured masonry blocks, comprising:

a mold comprising first and second mold cavities and a separating member separating the first and second mold cavities and being generally impervious to block-forming material, the mold having a top and a bottom, the first and second mold cavities being adapted to receive block-forming material for forming first and second blocks, respectively, and the separating member having first and second major surfaces, the first major surface forming an interior surface of the first mold cavity and the second major surface forming an interior surface of the second mold cavity;

wherein the mold has a first end defining openings for introducing block-forming material into the mold cavities and a second end defining openings for removing the blocks from the mold cavities, the first and second mold cavities having constant cross-sections from the first end to the second end of the mold; and a plurality of inwardly extending block-texturing members located along the first and second major surfaces of the separating member between the top and bottom of the mold, the block-texturing members being configured to produce a roughened texture on adjacent surfaces of the first and second blocks as they are removed from their respective mold cavities.

21. The apparatus of claim 20, wherein the block-texturing members are positioned side-by-side in rows of block-texturing members along the first and second major surfaces of the separating member.

22. The apparatus of claim 20, wherein the block-texturing members are generally frusto-pyramidal in shape.

23. The apparatus of claim 20, wherein the block-texturing members are generally pyramidal in shape.

24. The apparatus of claim 20, wherein the block-texturing members are positioned to scrape the adjacent surfaces of the first and second blocks as the blocks are removed from their respective mold cavities.

25. An apparatus for molding and forming at least one roughened surface texture on uncured masonry blocks, comprising:

a mold comprising a plurality of walls forming first and second mold cavities and said walls including a separating member separating the first and second mold cavities, the first and second mold cavities being adapted to receive block-forming material for forming first and second blocks, respectively, and the separating member having first and second major surfaces, the first major surface forming an interior surface of the first mold cavity and the second major surface forming an interior surface of the second mold cavity, wherein the mold has a first end defining openings for introducing block-forming material into the mold cavities and a second end defining openings for removing the blocks from the mold cavities, the first and second mold cavities having constant cross-sections from the first end to the second end of the mold;

a plurality of projections disposed on at least one of said walls of the mold and extending into the first mold cavity;

a plurality of projections disposed on at least one of said walls of the mold and extending into the second mold cavity; and a plurality of projections disposed on at least one of said first and second major surfaces of the separating member and extending into the adjacent mold;

whereby when the first and second blocks are removed from the mold, the projections produce at least two roughened surfaces on one of said first and second blocks and at least one roughened surface on the other of said first and second blocks.

26. The apparatus of claim 25, wherein each projection has two generally upwardly facing side surfaces and two generally downwardly facing side surfaces.

27. The apparatus of claim 26, wherein the two generally upwardly facing side surfaces of each projection have slopes that are less than the slopes of the two generally downwardly facing side surfaces.

28. The apparatus of claim 25, wherein a plurality of projections are disposed on both the first and second major surfaces of the separating member.

29. A wall for use in a mold for molding and forming at least one roughened surface texture on an uncured masonry block, comprising:

a body having first and second major surfaces, at least one of the first and second major surfaces having a plurality of projections extending outwardly therefrom, the projections tapering as they extend away from the body and arranged in rows of projections extending diagonally across the body so as to define grooves between adjacent rows extending diagonally across the body, the body having upper and lower ends and a thickness between the first and second major surfaces that is constant from the lower end to the upper end.

30. A wall for use in a mold for molding and forming at least one roughened surface texture on an uncured masonry block, comprising:

a body having first and second major surfaces, at least one of the first and second major surfaces having a plurality of projections extending outwardly therefrom, the projections tapering as they extend away from the body, the body having upper and lower ends and a thickness between the first and second major surfaces that is constant from the lower end to the upper end;

wherein the projections are frusto-pyramidal in shape.

31. The wall of claim 29, wherein the projections are pyramidal in shape.

32. The wall of claim 29, wherein both the first and second major surfaces has a plurality of projections extending therefrom.

33. The wall of claim 29, wherein each projection has a first side surface and a second side surface, the first side surface having a slope that is greater than the slope of the second side surface.

34. The wall of claim 29, wherein the body and the projections are of a unitary construction.

35. The wall of claim 29, wherein the projections are removable from the body.

36. A wall for use in a mold for molding and forming at least one roughened surface texture on an uncured masonry block, comprising:

a body having first and second major surfaces, the body having upper and lower ends and a thickness between the first and second major surfaces that is constant from the lower end to the upper end; and a plurality of projections extending outwardly from the first and second major surfaces.

37. The wall of claim 36, wherein the wall is incorporated into a mold, the wall separating the mold into first and second mold cavities.

38. The wall of claim 36, wherein the projections are tapered.

39. The wall of claim 36, wherein each projection has one side surface with a slope that is greater than that of another side surface.

40. The wall of claim 29, wherein the plurality of the projections include projections that include a four-sided base, wherein each side adjoins a side of a base of another of said projections having a four-sided base.

* * * * *